US006299385B1

(12) United States Patent
Barnes

(10) Patent No.: US 6,299,385 B1
(45) Date of Patent: Oct. 9, 2001

(54) MINI-JACKET AND METHOD FOR INSTALLATION USING CAISSON

(75) Inventor: John E. Barnes, Cypress, TX (US)

(73) Assignee: Paragon Engineering Services Incorporated, Houston, TX (US)

( * ) Notice: Subject to any disclaimer, the term of this patent is extended or adjusted under 35 U.S.C. 154(b) by 0 days.

(21) Appl. No.: 09/366,806

(22) Filed: Aug. 4, 1999

(51) Int. Cl.[7] ..... E02D 13/04
(52) U.S. Cl. ..... 405/227; 405/195.1; 405/204
(58) Field of Search ..... 405/195.1, 204, 405/222, 224, 227, 8, 9, 10, 11, 12, 13, 14; 166/358

(56) References Cited

U.S. PATENT DOCUMENTS

| | | | | |
|---|---|---|---|---|
| Re. 35,912 | * | 9/1998 | De Rosas et al. | 405/227 |
| 3,987,637 | | 10/1976 | Koehler | 61/97 |
| 4,561,802 | * | 12/1985 | Campo | 405/227 X |
| 4,739,840 | * | 4/1988 | Cox | 405/227 X |
| 4,740,107 | | 4/1988 | Casbarian et al. | 405/211 |
| 4,842,446 | | 6/1989 | Carruba | 405/227 |
| 4,907,657 | | 3/1990 | Cox | 175/9 |
| 4,917,541 | * | 4/1990 | Carruba | 405/227 |
| 4,983,074 | * | 1/1991 | Carruba | 405/227 |
| 5,012,875 | | 5/1991 | Casbarian et al. | 175/9 |
| 5,042,960 | * | 8/1991 | Tawfik et al. | 405/227 |
| 5,051,036 | * | 9/1991 | De Rosas et al. | 405/227 |
| 5,094,568 | * | 3/1992 | Carruba | 405/227 |
| 5,669,735 | * | 9/1997 | Blandford | 405/227 |
| 5,722,494 | * | 3/1998 | Landeck et al. | 405/227 |
| 5,899,639 | * | 5/1999 | Simmons | 405/227 |
| 5,988,949 | * | 11/1999 | Will | 405/227 X |
| 6,039,507 | * | 3/2000 | Kennelly et al. | 405/227 |

* cited by examiner

*Primary Examiner*—David Bagnell
*Assistant Examiner*—John Kreck

(57) ABSTRACT

A mini-jacket is installed using a caisson. The caisson is a tubular pipe that is either pre-existing in the field or specifically installed before hand, such that the bottom end of the caisson is driven into the ocean floor and its top end extends above the water surface. The mini-jacket is a structural frame with pile sleeves at the comers and a caisson sleeve located within the perimeter of the frame. The mini-jacket is configured and installed such that in its installed position its top surface is above water surface while its lower end remains above the ocean floor. During installation, the mini-jacket is lifted and lowered so that its caisson sleeve slides over the caisson. The caisson sleeve has weight bearing plates welded at the top. The mini-jacket is lowered until the weight bearing plates rest on the caisson, thereby transferring the weight of the mini-jacket to the caisson. The caisson alone supports the weight of the mini-jacket during the pile installation. In pile installation, the piles are driven through the pile sleeves of the mini-jacket into the ocean floor. The piles are then rigidly connected to the pile sleeves at the top. The deck of the mini-jacket is thus supported on the piles. Once the mini-jacket is installed, one or more wells can be drilled through the caisson in the conventional manner, and more wells that are supported at the mini-jacket can be added subsequently.

20 Claims, 7 Drawing Sheets

MINI-JACKET AND METHOD FOR INSTALLATION USING CAISSON

TECHNICAL FIELD OF THE INVENTION

The present invention relates generally to support platforms for offshore drilling and production, and more particularly to a mini-jacket support that can be installed with a minimal amount of lift equipment. Still more particularly, the present invention relates to a mini-jacket that can be supported solely by a caisson during installation of the supporting piles.

BACKGROUND OF THE INVENTION

In an offshore installation where a conventional jacket is used to support a well, the jacket itself rests on the ocean bottom. In order to keep the jacket from sinking into the ocean bottom, it is common to affix a plurality of large, flat, rigid plates, known as mudmats, to the bottom of the jacket. The mudmats rest on the sea floor and support the weight of the jacket until the piles are installed. The mudmats are designed to temporarily distribute the weight of the jacket and prevent it from sinking into the floor until the installation of the piles and the connection of the piles to the pile sleeves of the conventional jacket is completed. Once the piles have been installed and connected to the jacket, the weight of the jacket is carried by the piles and the mudmats become redundant.

The size of the mudmats required depends on the soil conditions at the ocean floor. In instances where the ocean floor is soft, the mudmats required are enormous in size and weight. Furthermore, in instances where the soil is extremely soft, besides large mudmats, a lift vessel is required to hold the conventional jacket so that it does not sink and remains level while piles are being installed. In addition, the pile installation procedure requires its own lift vessel. Therefore, two lift vessels may be required for pile installation. The first holds the jacket while the piles are being installed and connected to the pile sleeves of the jacket, and the second performs the pile installation.

Because the cost of providing any piece of equipment offshore is relatively high, it is desired to provide a technique for installing a jacket using a caisson without requiring either the extended use of jackup construction platform or large mudmats that are currently required.

In another scenario, a single well may have already been drilled by driving a caisson into the ocean floor. As disclosed in U.S. Pat. No. 5,012,875, a structural frame can be installed and connected to the caisson. The frame includes a plurality of pile sleeves, through which piles are driven into the ocean floor. The objective is to laterally brace the caisson and use the caisson to support a deck in order to support equipment needed to drill and produce a well. In other configurations, disclosed in U.S. Pat. Nos. 4,842,446 and 5,051,036, both the piles and the caisson support the deck on the top. In each of these inventions, the idea is to strengthen the caisson so that it can be used to support the deck. The caisson is pre-existing in all these cases and is attached to the side of the structural frame.

In these other configurations, the structural frame is attached to one side of the caisson, before the piles are installed, the weight of the frame tends to bend the caisson somewhat. It is usually necessary to provide a lift vessel to support the opposite side of the frame so as to maintain it level until the piles have been installed. Hence, it is desirable to provide a system for supporting a jacket during pile installation without incurring the expense of multiple lift vessels or extended lift vessel usage.

SUMMARY OF THE INVENTION

The present invention is a specially configured structural frame, or mini-jacket, that is installed using a caisson. The caisson is positioned within the perimeter of the mini-jacket. The height of the mini-jacket is less than the water depth at the point of installation, so the mini-jacket does not rest on the sea floor in its installed position and has a unique method for installation. Instead of being held by a lift vessel during pile installation, the weight of the mini-jacket is entirely supported by the caisson itself. The caisson can be either pre-existing in the field or specifically installed for this purpose. In instances where caisson does not exist at a site, a caisson is first installed using a lift vessel or a drilling rig in a manner well known to the art.

In a preferred embodiment, the mini-jacket comprises a structural frame having pile sleeves in its corners and a caisson sleeve located within its perimeter. During installation, the mini-jacket is lifted and lowered so that its caisson sleeve slides over the caisson. The caisson sleeve preferably has weight bearing plates or a similar means for engaging the caisson at its top. The weight bearing plates rest on the top of the caisson, thereby transferring the weight of the mini-jacket to the caisson. The caisson supports the weight of the mini-jacket during the pile installation, thereby eliminating the need for extended use of one or more lift vessels. With the mini-jacket resting on the caisson, the piles are driven through the pile sleeves of the mini jacket and the piles are connected to the pile sleeves in a conventional manner. The deck is installed on the piles. After the installation is complete, the wells may be drilled through the caisson, and additional wells may subsequently be added. The provisions for the support of the additional wells are preferably incorporated into the design of the mini-jacket.

By employing this method, the installation is simplified and its cost is reduced, as no lift vessel is required to hold the mini-jacket during pile installation. Similarly, the present invention eliminates the need to use mud-mats. The resulting mini-jacket is lighter than conventional jackets. The term mini-jacket is therefore used herein to distinguish from the conventional jackets that extend to the ocean floor. This invention has particular utility in instances where the exact water depth is not known. Since the mini-jacket does not rest on the ocean bottom, it is not necessary to know the exact water depth. Similarly, the mini-jacket design can be standardized such that the same mini-jacket can be used in a large range of water depths.

Another application of this invention is in mudslide areas. In mudslide areas the mud at the ocean bottom moves. If a conventional jacket that extends to the ocean bottom is used, the mudslide can generate large forces on the conventional jacket. In such cases, the conventional jacket needs to be stronger and should have piles driven deeper to tie it to the ocean floor. The use of the mini-jacket avoids the large mudslide forces, thereby allowing a lighter structure.

BRIEF DESCRIPTION AND DRAWINGS

For a more complete understanding of the following Description, reference will be made to the Figures wherein:

FIG. 1 is an elevational view of the final configuration of the present invention;

FIG. 2*a* is an elevational view of a mini-jacket constructed in accordance with the present invention;

FIG. 2*b* is a sectional view of the top of caisson sleeve of a preferred mini-jacket;

FIG. 2*c* is a top section of the caisson sleeve of FIG. 2*b* along the view line 2*c*—2*c;*

Figure 6A:
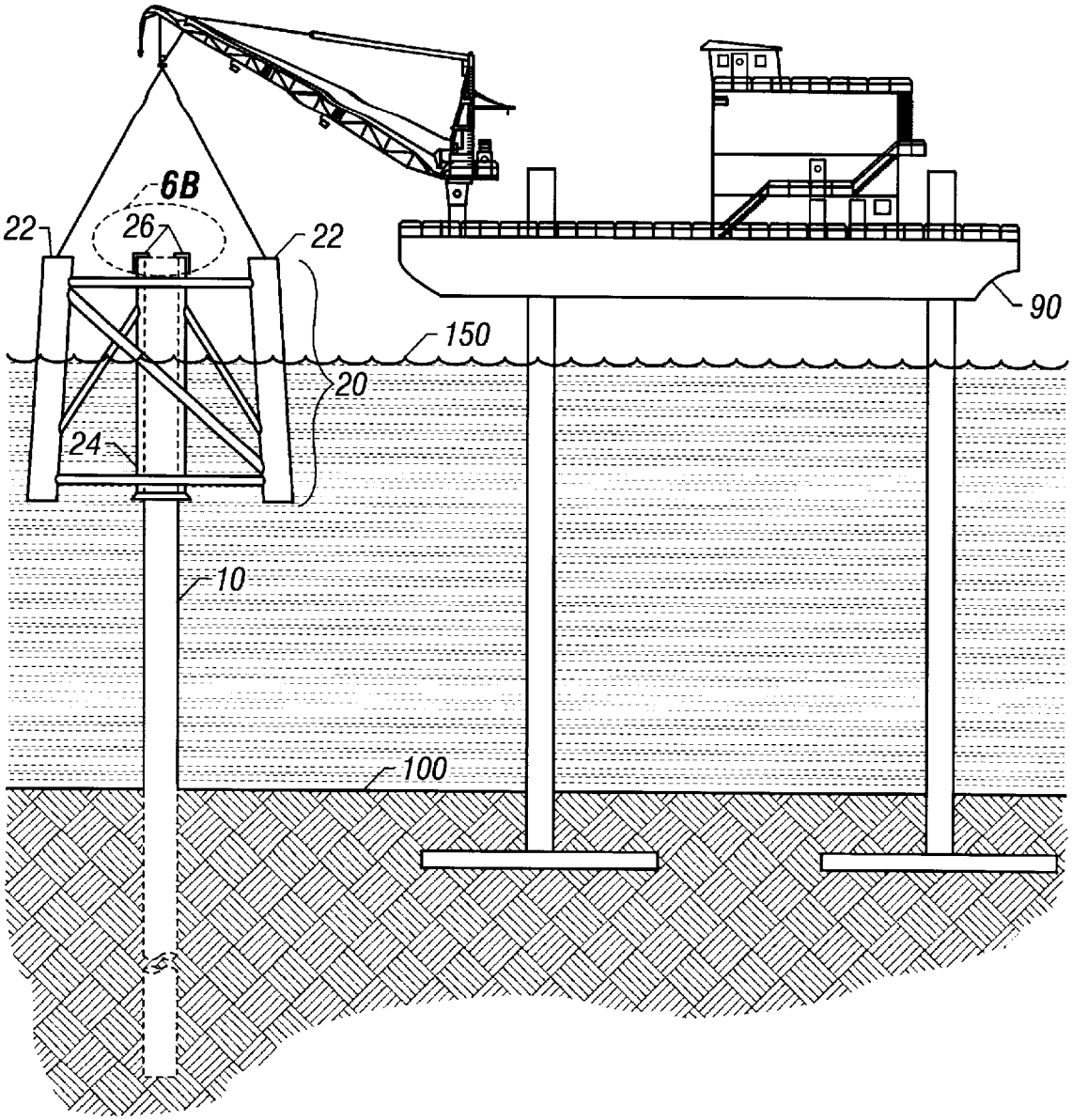
Figure 6B:
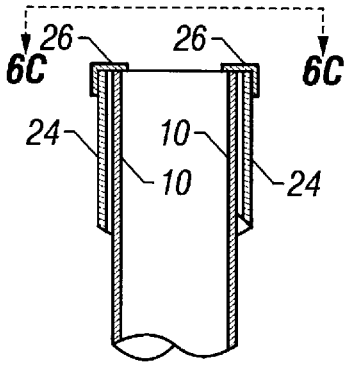
Figure 6C:
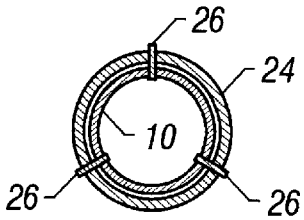

FIG. 6*a* shows the installation of the mini-jacket on the caisson using the lift vessel;

FIG. 6*b* is a top sectional view of the caisson sleeve and the caisson;

FIG. 6*c* is a sectional view of the caisson sleeve and caisson of FIG. 6*b* along the view line 6*c*—6*c;*

Figure 7:
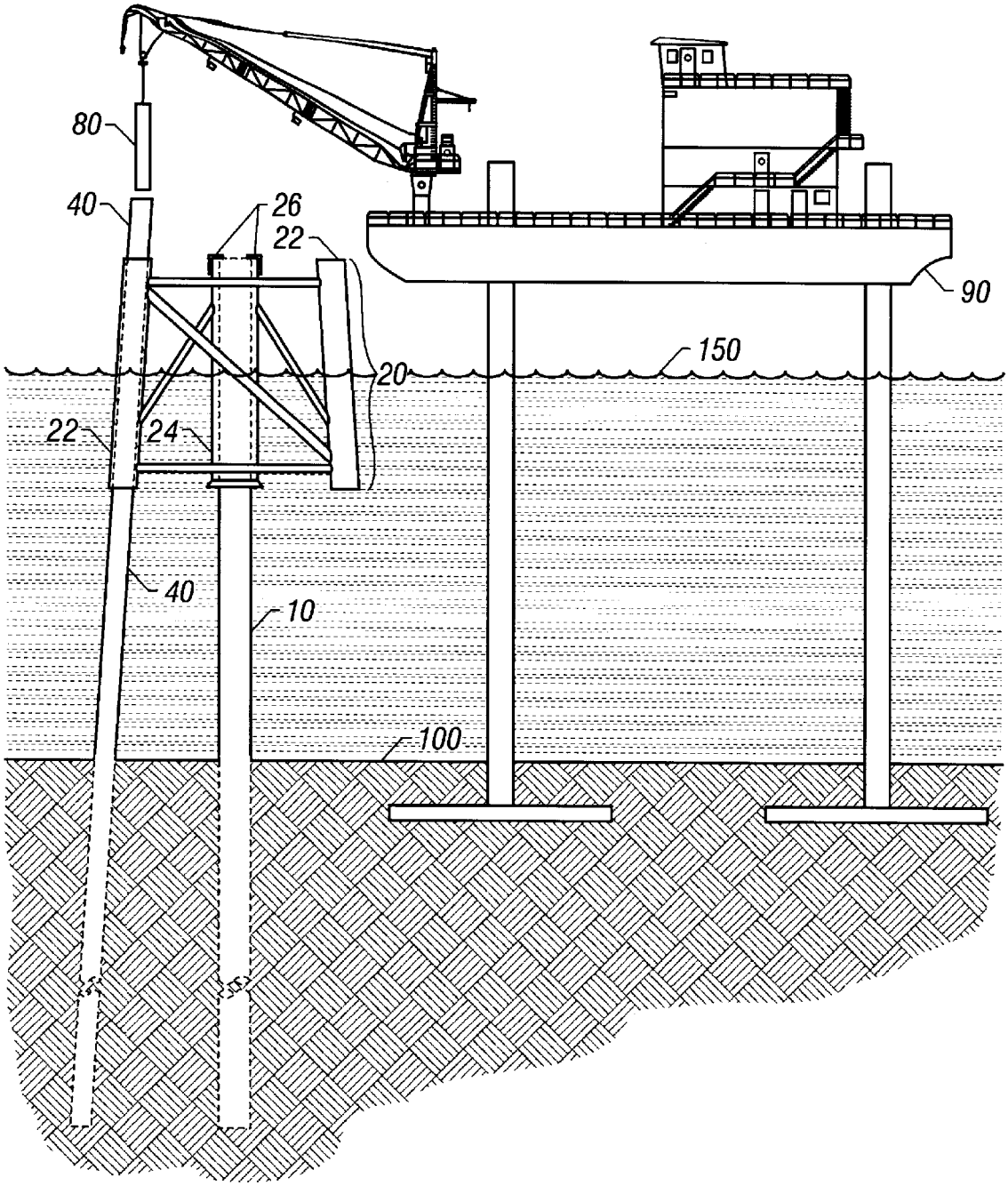

FIG. 7 shows the pile driving with lift vessel; and

Figure 8:
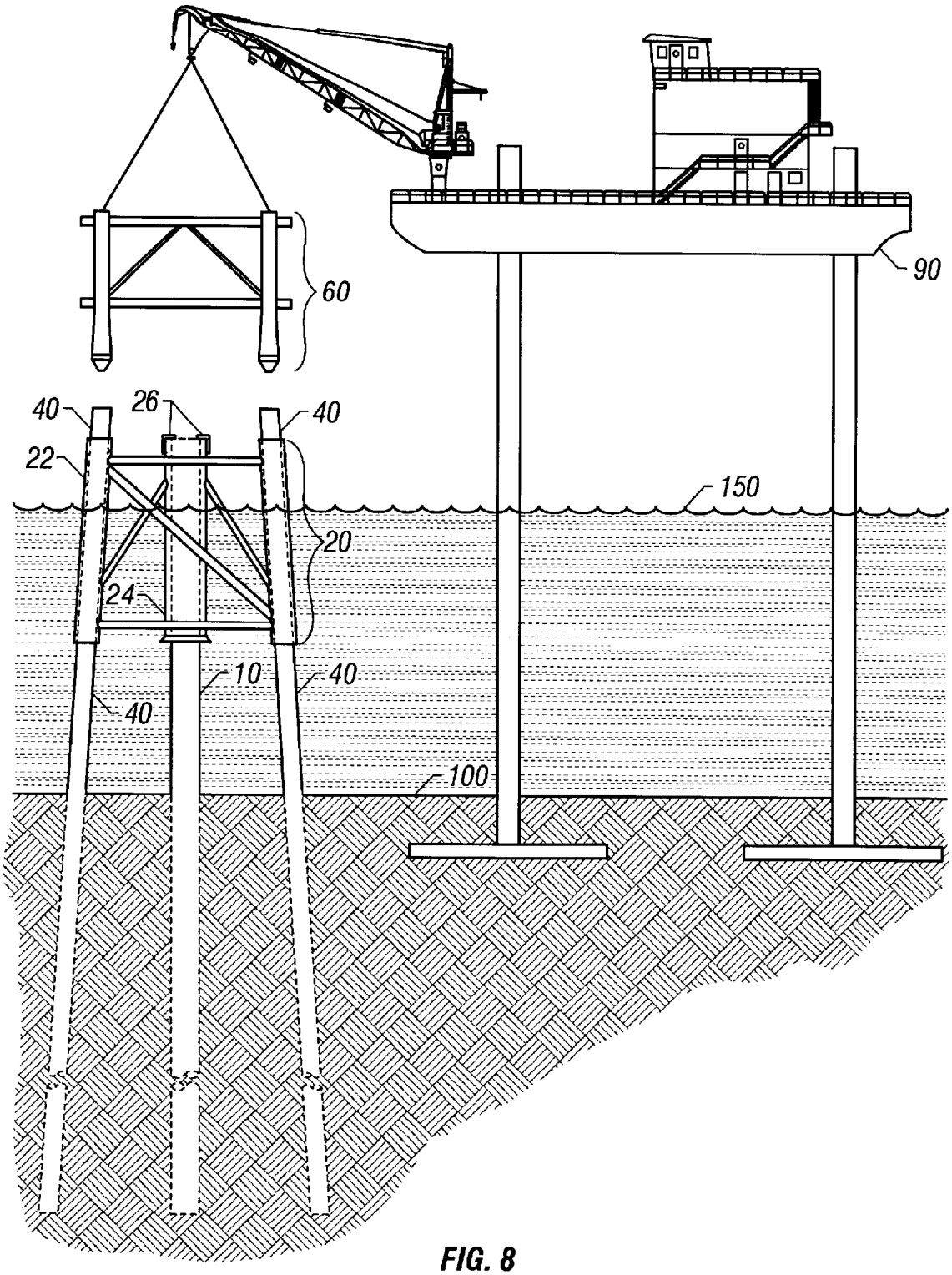

FIG. 8 shows the installation of the deck on the piles using a lift vessel.

DESCRIPTION OF A PREFERRED EMBODIMENT

In the following description, like parts are marked throughout the specification and drawings with the same reference numerals. The figures are not necessarily drawn to scale. Certain features not necessary to an understanding of the invention but which are normally included in offshore installation have been omitted. The omitted features are considered conventional and are well known to those skilled in the art.

Figure 1:
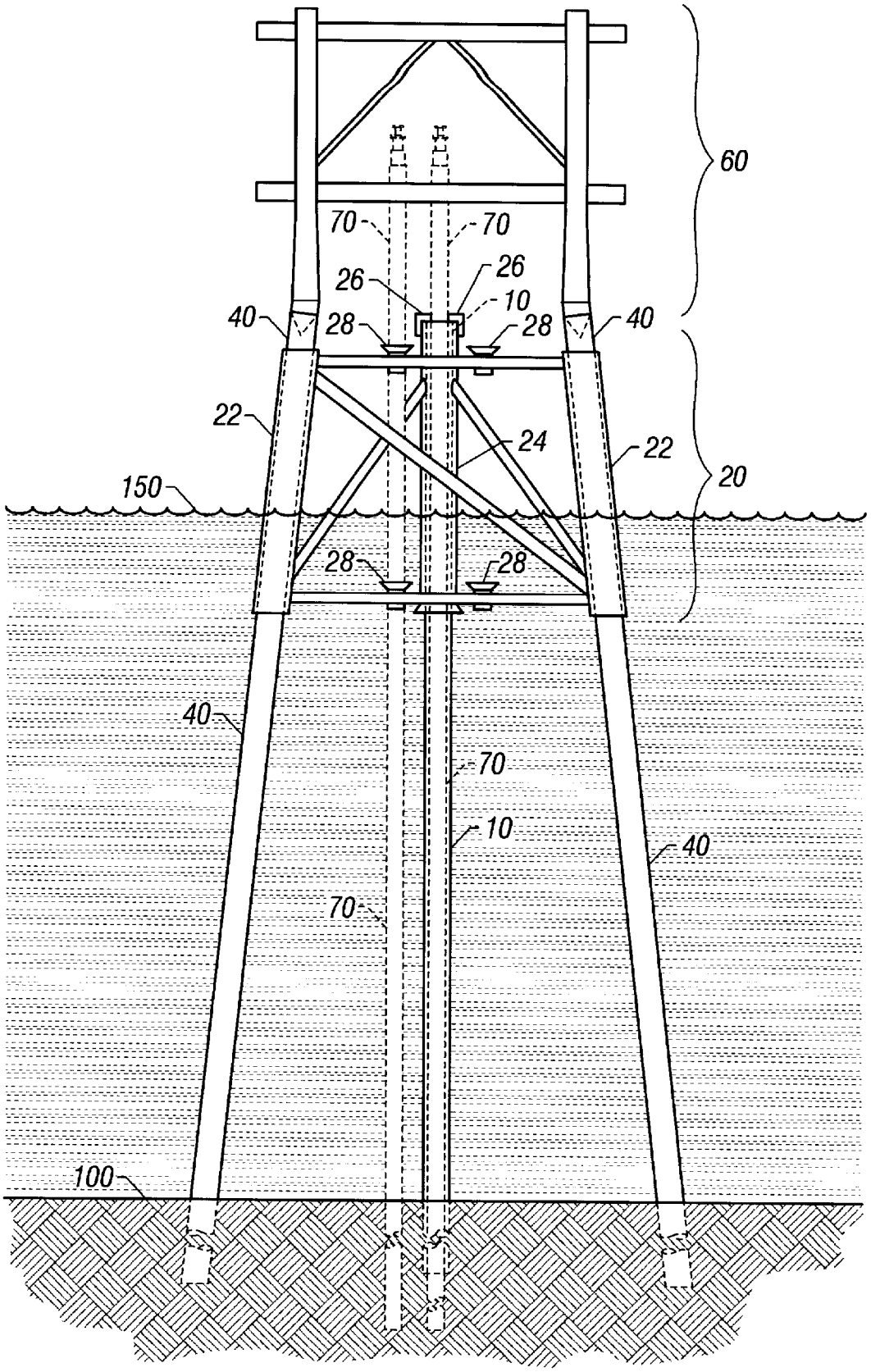

Referring initially to FIG. 1, according to a preferred embodiment, a caisson 10 has its bottom driven into the ocean floor 100 and its top extending above the water surface 150. A mini-jacket 20 constructed in accordance with a preferred embodiment comprises a three-dimensional structural frame with its bottom end above the ocean floor 100, and its top extending above the water surface 150. Mini-jacket 20 preferably has a plurality of pile sleeves 22 around its perimeter, a caisson sleeve 24 that is sized and adapted to fit over caisson 10, and a plurality of weight bearing plates 26, which are adapted to rest on caisson 10 so as to support the weight of mini-jacket 20 during pile installation. A plurality of piles 40 are driven through pile sleeves 22 of the mini-jacket 20 and are connected to pile sleeves 22 in a conventional manner. The tops of piles 40 support a deck 60. The well 70 is drilled through caisson 10. In an alternative embodiment, an additional well 70 may be drilled and supported at well conductor sleeve 28 of the mini-jacket 20.

Figure 2A:
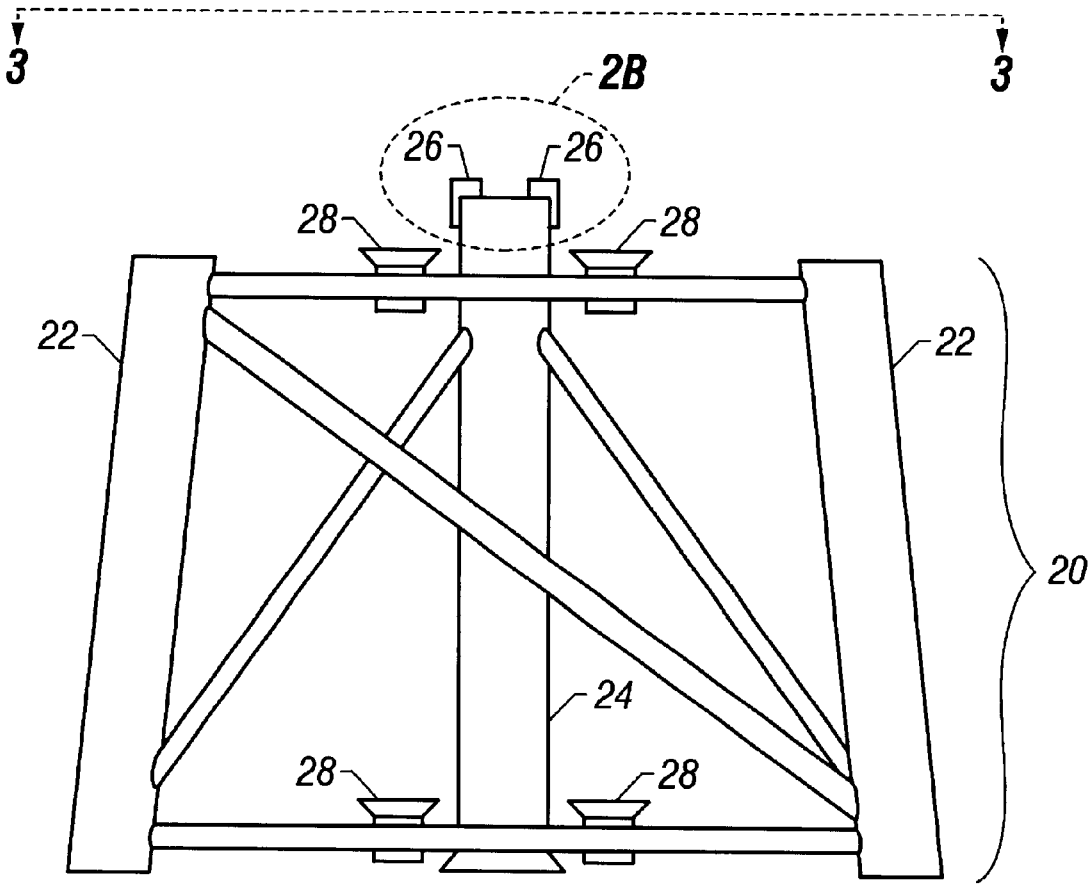

The components of a preferred mini-jacket 20 are shown in FIG. 2*a*, 2*b*, 2*c*, 3, and 4. FIG. 2*a* shows the elevation view of the mini-jacket 20. The various pile sleeves 22 are hollow tubular pipes located at the comers. According to the present invention, tubular caisson sleeve 24 is located within the periphery of the jacket, i.e. within the area 23 bounded by and encompassing pile sleeves 22. A preferred caisson sleeve 24 has weight bearing plates 26 affixed to its top end. Similarly, well conductor sleeves 28 are provided for future well supports.

Figure 2B:
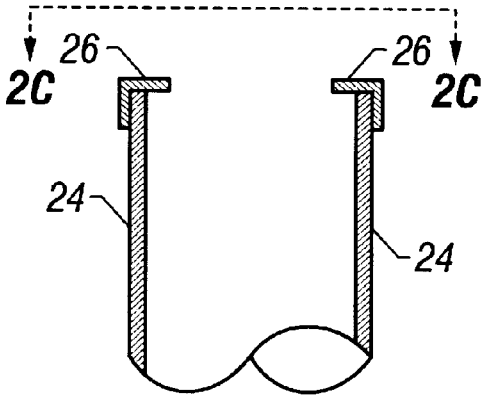
Figure 2C:
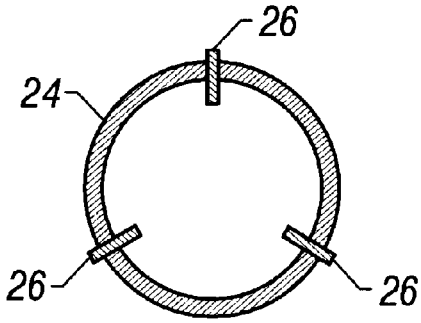
Figure 3:
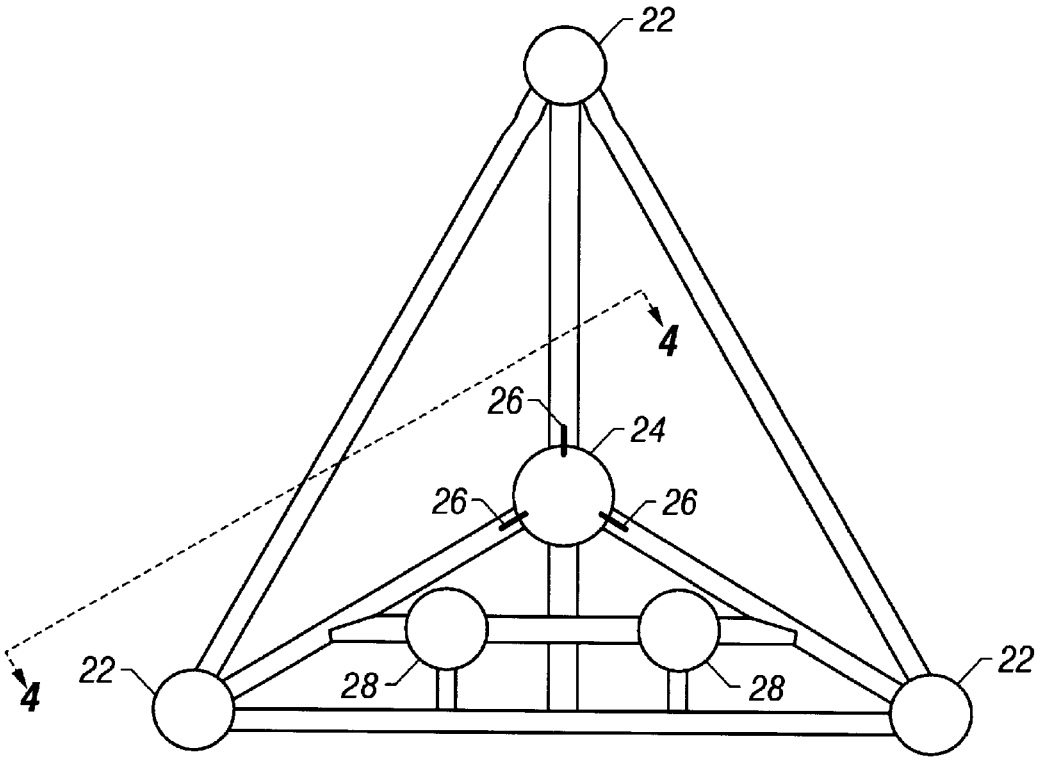
FIG. 3 is a plan view of the mini-jacket of FIG. 2*a* along line 3—3.
Figure 4:
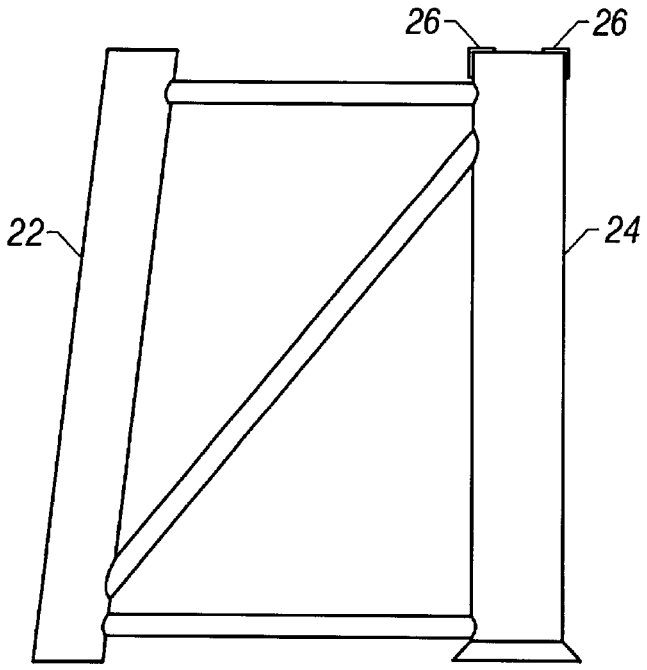
FIG. 4 is a side view of the mini-jacket of FIG. 3 along line 4—4.

FIG. 2*b* shows the top sectional view of the caisson sleeve 24. The weight bearing plates 26 are preferably welded to the caisson sleeve at the top. FIG. 2*c* is a top sectional view of the caisson sleeve 24 along line 2*c*—2*c* of FIG. 2*b*. FIG. 3 is a plan view of the mini-jacket 20. It shows the pile sleeves 22, the caisson sleeve 24, weight bearing plates 26, and the well conductor sleeves 28. FIG. 4 shows a side view of the mini-jacket 20 with the pile sleeve 22 and the caisson sleeve 24.

Figure 5:
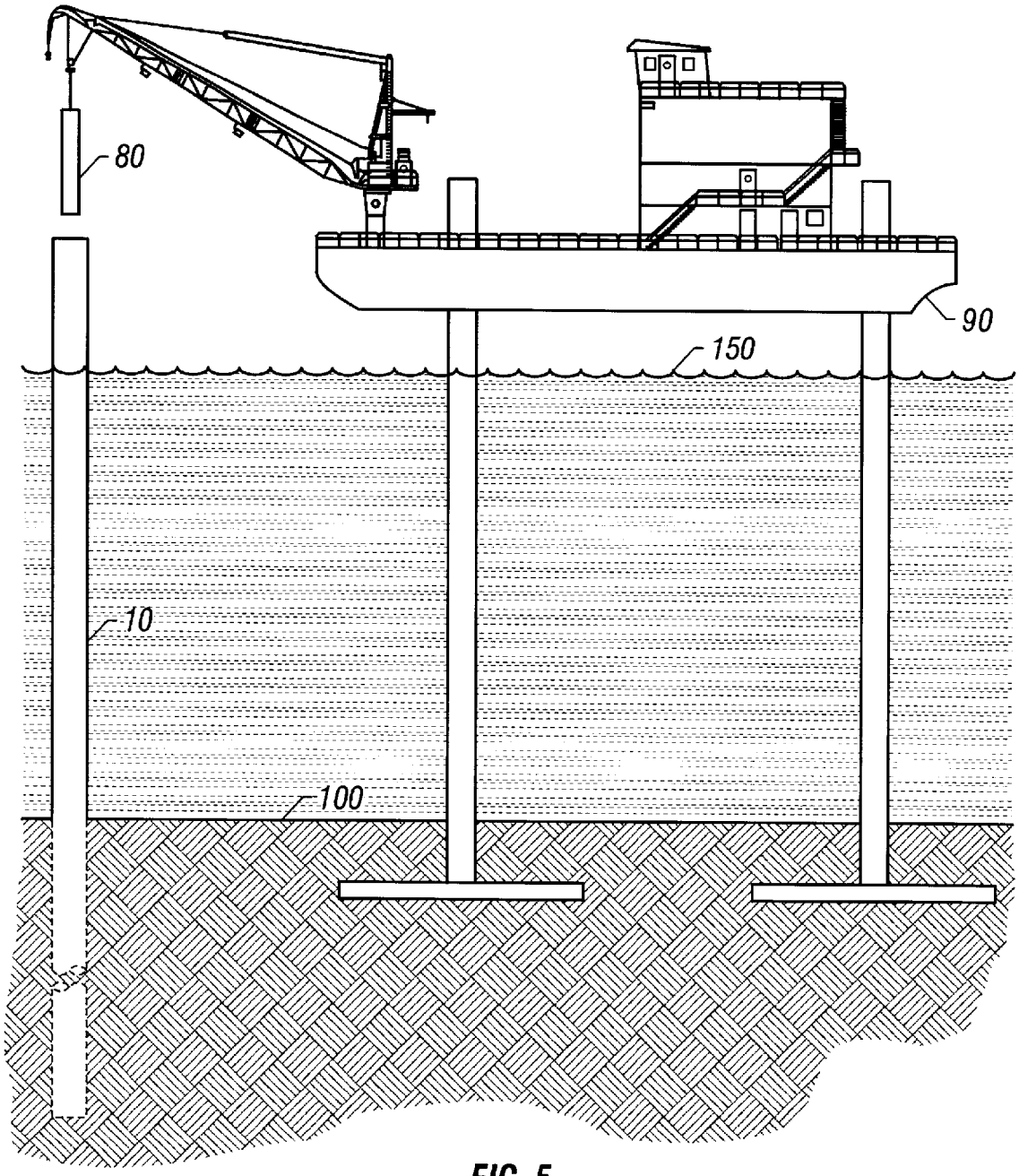
FIG. 5 shows the installation of the caisson using a lift vessel.

FIGS. 5, 6, 7, and 8 show the installation sequence. In some instances, caisson 10 will be pre-existing at the site. If caisson 10 is not pre-existing at the site, the installation of the caisson 10 is shown in FIG. 5. FIG. 5 shows the driving of the caisson 10 with a hammer 80 using a lift vessel 90; a procedure that is well known to those skilled in this art. Alternatively, instead of the lift vessel 90, a drilling rig or a derrick barge can be used throughout for the installation. The caisson 10 has its bottom driven into the ocean floor 100 and its top extends above the water surface 150.

FIG. 6*a* shows the step in which the mini-jacket 20 is lifted by the lift vessel 90. The caisson sleeve 24 slides over the caisson 10 and the mini-jacket is lowered until weight bearing plates 26 rest on the caisson 10. FIG. 6*b* illustrates the sectional view that shows weight bearing plates 26 resting on the caisson 10. FIG. 6*c* shows the top sectional view of the caisson sleeve 24 and caisson 10 and the location of the weight bearing plates 26. The weight of the mini-jacket 20 is supported by weight bearing plates 26. The figures show three weight bearing plates 26, placed at equal distance from each other. In practice, any number of plates can be used, with the provision that a minimum of two weight bearing plates 26 is required. Weight bearing plates 26 are preferably but not necessarily symmetrically placed. Once mini-jacket 20 is supported on caisson 10, the lift vessel 90 is no longer required to hold the jacket.

Alternatively, instead of weight bearing plates 26, caisson sleeve 24 can have a solid circular plate at the top, or ring plate at the top, or can be connected to caisson 10 by clamping, welding or by adding stopper plates to caisson 10. It is preferred that the manner in which mini-jacket 20 engages caisson 10 be such that it does not interfere with whatever well equipment may extend up through caisson 10. For example, if a well has already been drilled through caisson 10, a Christmas tree (not shown) or other equipment may form the top of the well. Mini-jacket 20 and the means by which caisson sleeve 24 engages caisson 10 are preferably configured to engage the caisson 10 while avoiding entanglement with or damage to the well equipment.

FIG. 7 shows the piles 40 driven through the pile sleeves 22 of the mini-jacket 20 with a hammer 80. After the piles 40 are driven, they are connected to their respective pile sleeves 22 in the manner well known to the art. For example, the top of the each pile may be connected to its surrounding pile sleeves by means of welding to crown blocks or shims. Alternatively, the piles can be grouted to the pile sleeves.

FIG. 8 shows the deck 60 being lifted so that it can be mounted or affixed to the tops of the piles 40. After deck 60 is installed, wells 70 may be driven through the caisson 10 as shown in FIG. 1. Subsequently, additional wells 70 may be driven and supported laterally by the well conductor sleeves 28 of the mini-jacket 20.

Unlike previously known jackets, the present mini-jacket can be supported solely by the caisson during the installation of the piles. Because it is configured so that it can be supported by the caisson alone, the present mini-jacket does not require additional equipment to support it while the piles are being driven and attached. The present invention achieves this result by having a caisson sleeve within its perimeter, and preferably approximately centrally located, and at least one caisson-engaging member that can support the mini-jacket and transfer its weight to the caisson. The caisson-engaging member can be the weight-bearing plates shown in the Figures, or other suitable load-bearing members. These include, solid circular plates, ring plates, cables, flanges, and other mechanical means for transferring the weight of the mini-jacket to the caisson.

While a preferred embodiment of the invention is shown and described, it will be understood that variations to the embodiment can be made without departing from the scope of the present invention. Likewise, the sequential description or claiming of certain steps of the present method is not intended to limit the present method to performance of those steps in that order or in any particular order, unless otherwise stated.

What is claimed is:

1. A method for providing a support system for an offshore drilling platform deck, comprising the steps of:

(a) providing a caisson that has its bottom end secured in the ocean floor and its top end above the water surface;

(b) providing a structural frame that includes a caisson sleeve within its perimeter and a plurality of pile sleeves, the structural frame having a height that is less than the water depth at the point where the caisson is installed and the caisson sleeve including at least one caisson-engaging member configured to allow passage of well equipment therethrough;

(c) lifting the structural frame over the caisson and lowering it so that the caisson sleeve engages the top of the caisson and slides along the caisson until the at least one caisson-engaging member engages the caisson;

(d) installing a pile in the ocean floor through each of said plurality of pile sleeves and affixing each pile to its sleeve.

2. The method according to claim 1 wherein step (d) is performed while the structural frame is supported solely by the caisson.

3. The method according to claim 1 wherein the structural frame is configured such that the pile sleeves define its perimeter and the caisson sleeve is disposed within the perimeter.

4. The method according to claim 1 wherein the caisson sleeve is located substantially in the middle of the structural frame.

5. The method according to claim 1 wherein the structural frame is installed such that its top extends above the ocean surface.

6. The method according to claim 1 wherein the at least one caisson-engaging member comprises a plurality of weight bearing plates affixed to the structural frame.

7. The method of claim 1, further including affixing a deck to the tops of the piles.

8. The method of claim 1, further including the step of drilling a well through the caisson.

9. The method of claim 1, further including providing the structural frame with at least one well conductor sleeve separate from said caisson sleeve and drilling a well through said conductor sleeve.

10. The method of claim 1 wherein step (c) is carried out using a drilling rig.

11. The method of claim 1 wherein step (c) is carried out using a lift vessel.

12. The method according to claim 1 wherein the at least one caisson-engaging member comprises a solid circular plate welded to the top of the caisson sleeve.

13. The method according to claim 1 wherein the at least one caisson-engaging member comprises a circular ring plate welded to the top of the caisson sleeve.

14. The method according to claim 1 wherein the at least one caisson-engaging member comprises at least one clamp affixed to the caisson.

15. The method of claim 1 wherein the structural frame has multiple caisson sleeves and steps (a) through (c) are performed using multiple caissons.

16. A method for providing a support system for an offshore drilling platform deck, comprising the steps of:

(a) providing a caisson that has its bottom end secured in the ocean floor and its top end above the water surface;

(b) providing a structural frame that includes a caisson sleeve within its perimeter and a plurality of pile sleeves, the structural frame having a height that is less than the water depth at the point where the caisson is installed and the caisson sleeve including at least one caisson-engaging member;

(c) lifting the structural frame over the caisson and lowering it so that the caisson sleeve engages the top of the caisson and slides along the caisson to a desired height;

(d) securing the caisson sleeves to the caisson by one of welding or clamping the caisson sleeve to the caisson;

(e) installing a pile in the ocean floor through each of said plurality of pile sleeves and affixing each pile to its sleeve.

17. The method according to claim 16 wherein step (e) is performed while the structural frame is supported solely by the caisson.

18. A structural frame for supporting an offshore drilling platform deck in conjunction with a caisson for drilling a well, comprising:

a plurality of pile sleeves defining a perimeter;

a rigid framework of structural members connecting said pile sleeves;

a caisson sleeve positioned within the perimeter and rigidly affixed to the framework and including a caisson-engaging member such that when said caisson sleeve is lowered onto the caisson, its caisson-engaging member engages the caisson and transfers the weight of the frame to the caisson and piles can be installed through said pile sleeves while the frame is supported solely by the caisson.

19. The frame according to claim 18 wherein the number of pile sleeves is three.

20. The frame according to claim 18, further including a structure for supporting at least one additional well.

* * * * *